US005155997A

United States Patent [19]

McGushion

[11] Patent Number: 5,155,997

[45] Date of Patent: Oct. 20, 1992

[54] FORCE-AMPLIFYING ACTUATOR WITH CAPSULE-TYPE TRANSMISSION

[76] Inventor: Kevin D. McGushion, 2450 Oak St. #E, Santa Monica, Calif. 90405

[21] Appl. No.: 613,616

[22] Filed: Nov. 15, 1990

[51] Int. Cl.[5] ..... F15B 7/00

[52] U.S. Cl. ..... 60/583; 60/533; 92/98 D; 92/84; 74/516

[58] Field of Search ..... 92/98 D, 89, 90, 140, 92/84; 60/533, 561, 562, 565, 581, 583; 74/110, 516, 517, 518

[56] References Cited

U.S. PATENT DOCUMENTS

| | | | |
|---|---|---|---|
| 1,622,896 | 3/1927 | Lowenstein | 60/583 |
| 2,208,149 | 7/1940 | Vernet | 92/84 |
| 2,623,361 | 12/1952 | Dungler | 60/583 |
| 3,071,930 | 1/1963 | Moulin | 60/533 |
| 3,668,871 | 6/1972 | Berndt et al. | 60/533 |
| 3,800,674 | 4/1974 | Sember et al. | 60/533 |
| 4,995,587 | 2/1991 | Alexius | 92/84 |

FOREIGN PATENT DOCUMENTS

| | | | |
|---|---|---|---|
| 0955613 | 1/1950 | France | 60/583 |
| 0769124 | 10/1980 | U.S.S.R. | 92/90 |

*Primary Examiner*—Edward K. Look
*Assistant Examiner*—Thomas Denion
*Attorney, Agent, or Firm*—Donald D. Mon

[57] ABSTRACT

A fluid transmission linear actuator having a chamber with a cylindrical boundary and a central axis. An output plunger has a head in the boundary. A neck is formed on the chamber with a passage entering it. An input plunger is axially movable in the neck. The input plunger and the ouput plunger are coaxial. A transmission capsule has a continuous skin forming a first reentrant fold between the output plunger and the boundary, and a second reentrant fold between the neck and the input plunger. A substantially incompressible fluid fills the capsule so that movement of either plunger results in proportional movement of the other plunger. This input plunger can be formed with an exponential surface so that its movement can result in a non-linear response, or in some circumstances can provide a linear output in response to a non-linear input.

8 Claims, 2 Drawing Sheets

FORCE-AMPLIFYING ACTUATOR WITH CAPSULE-TYPE TRANSMISSION

FIELD OF THE INVENTION

This invention relates to a force-amplifying linear actuator.

BACKGROUND OF THE INVENTION

Linear actuators are widely used to operate mechanical devices, especially in the aircraft, aerospace, and automotive fields. Rack-and-pinion and worm gears driven by electric motors are common examples. Hydraulic piston/cylinder assemblies are another common example.

Such actuators are widely used despite their disadvantages. The electrically driven units require relatively heavy motors whose rotary output must be converted to linear motion, again by heavy mechanisms. In airborne or space applications, such extra weight is a serious penalty.

Hydraulically or pneumatically driven actuators require hydraulic or air lines which can be cut or might otherwise leak past the seals which are necessary for the assembly of the system. Further, sliding seals are required in the actuators themselves, and these involve friction losses, requiring overdesign of the system to assure an adequate force output, as well as the risk of leakage. These devices require an external power-fluid supply, which itself is bulky and subject to malfunction.

The reduction of friction enabled by the transmission of this invention is very important when the actuating force is derived from a relatively weak source such as an electromagnetic solenoid.

It is an object of this invention to provide a force-amplifying linear actuator which, while it includes a transmission, is self contained and independent of external fluid supplies. It can be powered by a simple plunger. Because of the capsular construction of the transmission, it requires no static or sliding seals, and therefore operates with minimal friction losses.

It is another object of this invention to provide an actuator whose energy is supplied merely by electrical conductors, which can be provided with redundant systems, and which can provide a linear output from a non-linear electromagnetic supply without need for rotary-to-linear conversion means, or a non-linear output from a linear input.

It is another object of this invention to provide a linear actuator whose rate of extension and force can be "tailored" to suit an intended installation, simulating the effect of a cam device.

BRIEF DESCRIPTION OF THE INVENTION

An acutator according to this invention includes a body having an input cylinder and an output cylinder, these cylinders being coaxial and having respective diameters. The diameter of the output cylinder is larger than the diameter of the input cylinder when the amplification is to be positive, and smaller when the amplification is to be negative. Both positive and negative amplification are comprehended by this invention.

An input plunger is axially shiftable in the input cylinder. An output plunger is axially shiftable in the output cylinder.

A transmission chamber is defined by the output cylinder and the output plunger. The input cylinder opens into the transmission chamber.

A transmission capsule fits in the transmission chamber. The capsule has a flexible skin which bounds an internal cavity. The cavity is closed, and is filled with a substantially incompressible fluid. The skin has limited elasticity, sufficient to enable it to change its surface area in response to the change in volumetric configuration of the capsule which results from the shifting of the two plungers in the two cylinders, and flexible enough to enable re-entrant movement required by the capsule.

The skin of the capsule has a re-entrant neck which enters the input cylinder. The input plunger bears against the end of the neck, and as it moves axially, it makes a rolling re-entrant fold in the neck. Its movement displaces fluid into that portion of the capsule which is in the output cylinder.

Similarly, the output plunger makes re-entrant contact with the capsule at the output side. It makes a re-entrant fold which usually will have a larger diameter than the fold in the input cylinder, although it may be smaller instead. The rolling folds constitute peripheral seals around the two plungers, so there is no need for sliding seals, and friction is essentially eliminated.

Drive means is coupled to the input plunger. According to a preferred but optional feature of this invention, the drive means is magnetically responsive either by way of solenoid type operation, or by way of manipulation of magnets.

According to a preferred but optional feature of the invention, the input plunger is shaped relative to the input cylinder such that it displaces a varying volume of fluid as a function of its own axial movement, thereby "tailoring" the output relative to its own force or displacement.

The above and other features of this invention will be fully appreciated from the following detailed description and the accompanying drawings, in which:

DETAILED DESCRIPTION OF THE INVENTION

Figure 1:
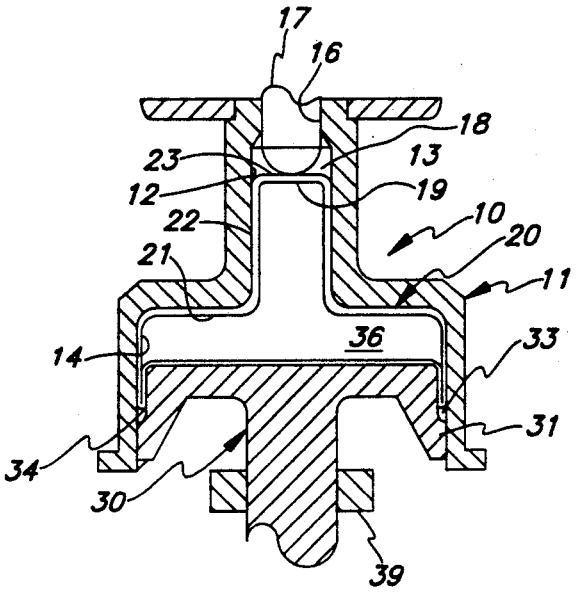
FIG. 1 is an axial cross-section of the presently-preferred embodiment of the invention in one operating position.

A linear actuator 10 according to this invention is shown in FIG. 1. It has a body 11 that encloses an input cylinder 12 in neck 13, and an output cylinder 14. Linear axis 15 is preferably common to both cylinders, although they could be offset, or even at an angle to one another if preferred. Input cylinder enters the output cylinder. The diameter of the output cylinder is larger than the diameter of the input cylinder. Both are right circular cylinders.

Neck 13 surrounds a cylindrical bearing 16 in which an input plunger 17 is axially slideable. Plunger 17 is cylindrical, and has a nose 18 at its free end 19.

Figure 2:
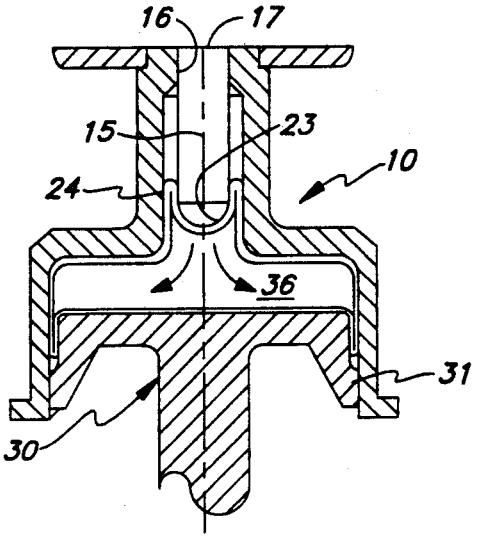
FIG. 2 is a showing as in FIG. 1, in which the actuator is in another operating position.
Figure 3:
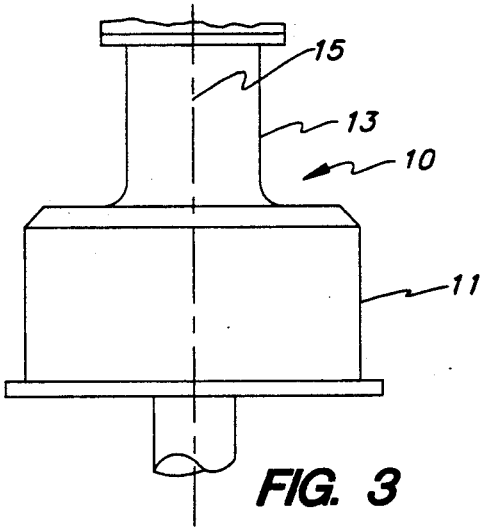
FIG. 3 is a side view of FIG. 1.

As can best be seen in FIGS. 1 and 2, a capsule 20 has a skin 21 made of a flexible material. Due to changes in its configuration during operation, this skin must have some limited elasticity, but elasticity is not its principal property. The device is shaped, proportioned and surrounded so it cannot balloon. The thickness and properties of the material are selected to enable only limited stretch. Fabric mesh embedments in the capsule material may be used to control the stretch if desired.

The capsule has a neck 22 which fits in the input cylinder. It has a working face 23 which is abutted by the nose of the input plunger. The diameter of the shaft of the input plunger is sufficiently smaller than the diameter of the input cylinder that the skin of the neck can make a re-entrant fold 24 when the input shaft is moved into the neck without rubbing on itself. Dimensions which provide a small spacing at the center of the fold eliminate friction. However, the spacing is kept small enough that the capsule does not tend to balloon at the fold.

An output plunger 30 has a head 31 which fits in the output cylinder. The output plunger has a reduced diameter output shaft 38 that is side-supported by a bushing 39. There is no intentional sliding fit between the head and the wall of the output plunger.

A peripheral recess 33 extends around head 31 to enable re-entrant fold 34 of the skin to be formed. Again, the relative diameters are such as to enable this fold to be formed and for the walls of the fold to move along each other without rubbing, and without ballooning. The spacing between the walls of the fold will enable fluid 36 in the capsule to act as a lubricant.

The capsule is filled with a substantially incompressible fluid. The presently-preferred fluid is a silicone, and the preferred material for the skin is a cured silicone polymer. The skin may be reinforced with a polypropylene mesh or other reinforcement as desired.

A consideration of the geometry of the device of FIG. 1 will show that the rate of movement of the output plunger is inverse to the rate of the input plunger. The output force will also be inversely related, because the fluid in the capsule interlinks the two plungers, and exerts the same pressure against both plungers. In many devices, the output plunger will work against a return spring so the input plunger will be required to exert a larger force as it moves farther into the neck. These are ordinary considerations, obvious to the skilled person.

Conversely a varying input force can unless provisions are made to avoid it, result in varying output forces. An example is where an electromagnetic solenoid is used as a power source. The tendency of the solenoid armature is to center itself in the wiring which generates the magnetic field. The resultant linear output force derived from a given strength of magnetic field varies as a function of the position of the solenoid in the winding. In many installations this is tolerable, but in in others it is not.

Figure 4:
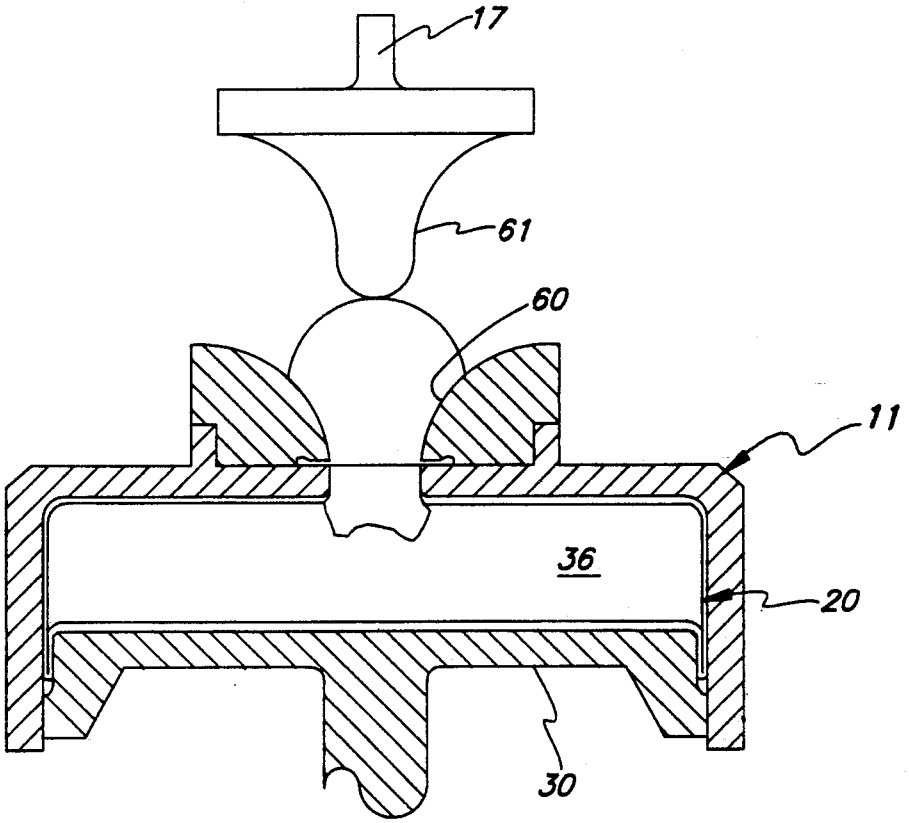
FIG. 4 is an axial cross-section of another embodiment of the invention.

To correct this situation, the input cylinder is modified to include a shaped throat 60 and the input plunger is modified to include a shaped nose 61 FIG. 4. These surfaces will usually be matching complements of one another, and will be of an exponential shape. The shapes must be determined on a unit-by-unit basis, often with some trial and error, because they will be in part determined by the forces expected to be applied, and in large part by the unit fluid displacement as related to unit movement of the input plunger. Whatever the situation, a ready linear solenoid movement vs output force graph can result.

The term "cylinder" is used herein in its mechanical sense, and not strictly in its geometric sense. The shaped portion 60 of the neck is spoken as part of the input cylinder.

Figure 5:
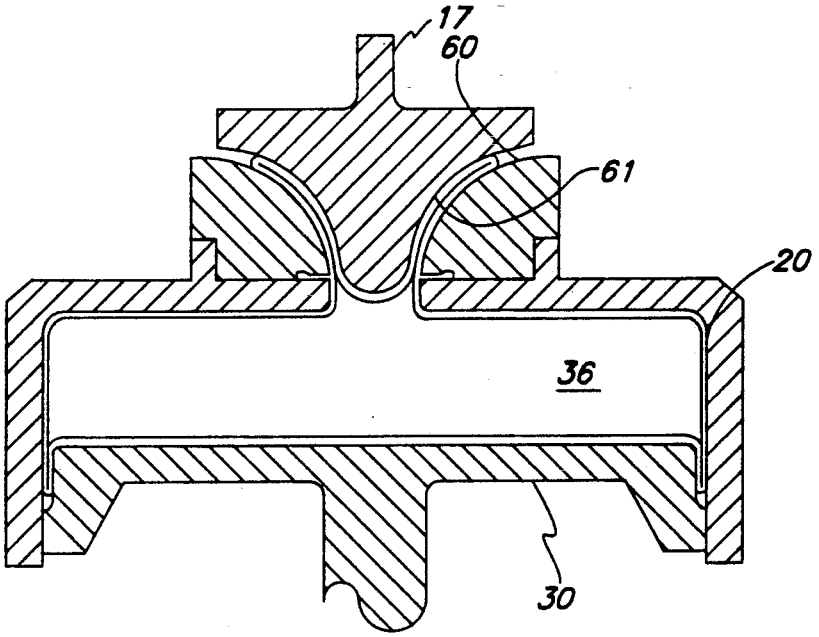
FIG. 5 is a showing as in FIG. 4, in which the actuator is in another operating position.

FIGS. 2 and 5 show the elements of FIGS. 1 and 4, respectively, in more extending position of the output plunger.

Figure 6:
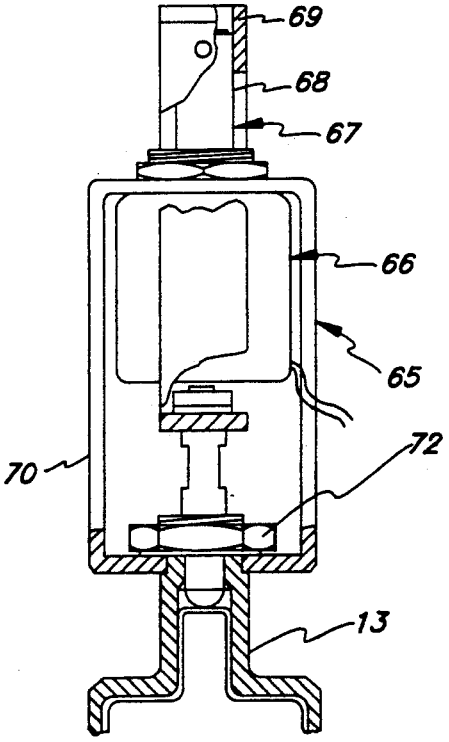
FIG. 6 is a side view, partly in cutaway cross section, showing drive means for use with the devices of FIGS. 1 and 3.
Figure 7:
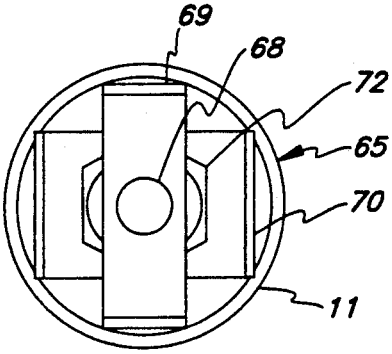
FIG. 7 is a top view of FIG. 6.

FIGS. 6 and 7 show a structure 65 incorporating the devices of FIGS. 1-5, and in addition a force means 66, in this case a schematically shown electromagnetic solenoid 67 whose armature 68 is linked by a yoke 69 to the input plunger. A frame 70 supports the winding 71 of the solenoid, and is mounted to the neck of the actuator. Net 72 is threaded to the neck, and clamps the frame between them.

Force means other than solenoids can be utilized, including rotary motors and the like, but they usually will involve penalties of greater weight and the need for rotating to linear conversion. The device as shown is simple, elegant in concept, and in the event of damage to the system, can leak only from the capsule. It is therefore a highly reliable remote actuator which dispenses with hydraulic lines, and which can provide amplified forces in a wide range of force and displacement relationships.

This invention is not to be limited by the embodiments shown in the drawings and described in the description, which are given by way of example and not of limitation, but only in accordance with scope of the appended claims.

I claim:

1. A fluid transmission linear actuator comprising:
- a chamber having a cylindrical boundary and a central axis;
- an output plunger having a head within said boundary, partially bounding said chamber and axially movable in said boundary;
- a neck on said chamber with a passage entering said chamber;
- an input plunger axially movable in said neck and coaxial with said output plunger;
- a transmission capsule having a continuous impermeable skin forming a first reentrant fold between said output plunger and said boundary, and a second reentrant fold between said neck and said input plunger, and a substantially incompressible fluid filling said capsule and fully confined by said skin, whereby linear movement of said input plunger results in amplified movement of force by said output plunger said movement requiring rolling movement of both of said reentrant folds.

2. A linear actuator according to claim 1 which said input plunger is a right circular cylinder.

3. A linear actuator according to claim 1 in which said input plunger is an exponential surface of revolution, and in which said neck includes a complementary surface of revolution into which the input plunger extends, whereby the output force derived from a given increment of input plunger movement can be varied according to the shape of said surface of revolution.

4. A linear actuator according to claim 1 in which said capsule skin projects as a tubular member into said neck, said reentrant folds having opposed arms spaced apart from one another, whereby the fluid acts as a lubricant between them.

5. A linear actuator according to claim 1 in which said fluid is a silicone, and in which said skin is a cured silicone.

6. In combination: a linear actuator according to claim 1; and force means coupled to one of said plungers to exert pressure in said capsule.

7. A combination according to claim 6 in which said force means is an electromagnetic solenoid, the armature of said solenoid being coupled to one of said plungers.

8. A combination according to claim 7 in which said input plunger is an exponential surface of revolution, and in which said neck includes a complementary surface of revolution into which the inlet plunger extends, whereby the output force derived from a given increment of plunger movement can be varied according to the shape of said surface of revolution.

* * * * *